US008328029B1

(12) United States Patent
Binsfeld et al.

(10) Patent No.: US 8,328,029 B1
(45) Date of Patent: Dec. 11, 2012

(54) STORAGE RACK

(76) Inventors: Arthur J. Binsfeld, Paynesville, MN (US); Michael A. Oevermann, St. Martin, MN (US)

( * ) Notice: Subject to any disclaimer, the term of this patent is extended or adjusted under 35 U.S.C. 154(b) by 2563 days.

(21) Appl. No.: 10/411,047

(22) Filed: Apr. 9, 2003

Related U.S. Application Data

(60) Provisional application No. 60/371,391, filed on Apr. 9, 2002.

(51) Int. Cl.
*A47F 7/00* (2006.01)

(52) U.S. Cl. ..... 211/85.7; 211/182; 211/204; 211/180; 187/240; 187/259

(58) Field of Classification Search ..... 211/182, 211/85.8, 85.7, 70.5, 175, 180, 195, 204, 211/206, 1.56; 254/286; 187/240, 259
See application file for complete search history.

(56) References Cited

U.S. PATENT DOCUMENTS

| | | | | | |
|---|---|---|---|---|---|
| 263,151 | A | | 8/1882 | Edmonds | |
| 471,900 | A | | 3/1892 | Sandy | |
| 1,259,942 | A | | 3/1918 | Weaver | |
| 1,368,668 | A | * | 2/1921 | Von Deest | 182/144 |
| 1,745,042 | A | * | 1/1930 | Romine | 254/280 |
| 2,528,672 | A | * | 11/1950 | Sullivan | 414/460 |
| 2,529,948 | A | * | 11/1950 | Jones | 254/281 |
| 2,632,900 | A | * | 3/1953 | Voigt | 114/365 |
| 3,720,358 | A | * | 3/1973 | McIntire | 414/462 |
| 3,734,466 | A | | 5/1973 | Mason | |
| 3,872,972 | A | | 3/1975 | Cummins et al. | |
| 3,902,613 | A | * | 9/1975 | Newland | 414/538 |
| 4,263,925 | A | * | 4/1981 | Arganbright | 135/137 |
| 4,861,218 | A | | 8/1989 | Lamer | |
| 4,928,927 | A | * | 5/1990 | Fredrick et al. | 254/279 |
| 4,954,038 | A | * | 9/1990 | Sheahan | 414/482 |
| 5,016,893 | A | * | 5/1991 | Hart, Jr. | 280/35 |
| 5,178,444 | A | * | 1/1993 | May et al. | 312/265.3 |
| 5,281,077 | A | * | 1/1994 | Phillips | 414/678 |
| 5,362,196 | A | | 11/1994 | Beattle et al. | |
| 5,797,504 | A | | 8/1998 | Mangum | |
| 5,813,659 | A | | 9/1998 | Heidle | |
| D412,384 | S | * | 7/1999 | Lisburg | D34/28 |
| 5,988,597 | A | | 11/1999 | Egan | |
| 6,056,274 | A | | 5/2000 | Naas et al. | |
| 6,161,702 | A | | 12/2000 | Campbell | |
| 6,361,022 | B1 | | 3/2002 | Lob et al. | |
| 6,386,515 | B1 | | 5/2002 | Sachtleben | |
| 7,861,828 | B1 | * | 1/2011 | Shepard | 187/211 |

* cited by examiner

*Primary Examiner* — Michael Mansen
*Assistant Examiner* — Juan Campos, Jr.
(74) *Attorney, Agent, or Firm* — Albert W. Watkins

(57) ABSTRACT

Exemplary embodiments provide a generally open-frame storage rack having a pair of overhead bridging lifts, each lift further having a pair of side opposed cables extending therefrom. The framework for the storage rack is fabricated using stock automotive exhaust components, which yields a synergistic combination of ready reforming, substantial strength, low weight, and excellent corrosion and chemical resistance. The preferred rack structure is assembled from sufficiently short lengths to enable shipment using standard commercial carriers and rates. Additional novel features and combinations are also disclosed.

15 Claims, 2 Drawing Sheets

STORAGE RACK

CROSS REFERENCE TO RELATED APPLICATIONS

This application claims priority to U.S. provisional application Ser. No. 60/371,391 filed Apr. 9, 2002 and herewith, the contents which are hereby incorporated by reference in entirety.

BACKGROUND OF THE INVENTION

1. Field of the Invention

The present invention pertains generally to implements and apparatus for applying pushing or pulling forces, and more particularly to a hoist pulling on a cable with one or more cable drums, cable guides and plural cables. Most particularly, the invention pertains to a multiple cable lift which is configured to elevate and store motorized equipment.

2. Description of the Related Art

An old adage states that a person's possessions grow to fill the available space, and nowhere is this more true than in the garages of most persons. With precious little land area and high costs for expanded building square footage, many homeowners and renters find themselves without adequate space for the tools, equipment and vehicles that they wish to provide shelter and secure storage for. Consequently, there has always been a need for ways to provide more organized or efficient storage which will readily accommodate the equipment and tools, while not placing either the equipment or the owner at risk of harm.

Certain types of equipment and vehicles have presented more difficult challenges over time. One such example is the case of a snowmobile, which has only skis and track, neither which are well-suited for ready movement about concrete or similar garage flooring. Consequently, placement of the snowmobile is preferably made with the intent not to have to move the snowmobile to gain access to other items within the garage or storage building. However, the snowmobile takes up a substantial amount of floor space and yet extends only nominally vertically above the floor. Consequently, it is desirable to provide a way to elevate the snowmobile, and then either use the space below the snowmobile for work area or for the storage of additional equipment or vehicles. The need to find such storage increases with the increasing numbers of snowmobiles owned by a person, since, without other arrangement, available floor space will rapidly be consumed with only a few snowmobiles. Similar problems and considerations may be found with much recreational and other outdoor power equipment, including boats, personal watercraft, all-terrain vehicles, lawn mowers, recreational vehicles, utility vehicles, lawn and garden tractors, and other transportation and entertainment related equipment, though the extent of the problem may be somewhat less consequential than with snowmobiles.

As a corollary to the primary issue of space, there is also a general need to inspect, adjust and service many of these vehicles and related sporting equipment from the underside. Tasks as basic as changing oil, tires, skis or the like can be difficult when the vehicle remains supported upon itself. Consequently, it has long been desired to provide an apparatus which benefits a user with more efficient storage space and also enables improved access for servicing and inspection. Additional needs arise in the retail display of units, particularly snowmobiles, where the track is relatively difficult or impossible to view when the snowmobile is on the ground.

Similarly, the large showroom floor space required to display an assortment of snowmobiles adversely affects snowmobile dealers.

Conventional hoists, which utilize one or more lifts and supports that extend from the lift under the vehicle have been proposed. Unfortunately, the underbody support required by these types of lifts often times interferes with the desired underbody access. Furthermore, with the very diverse types of bodies and undercarriages that exist in the list of vehicles and equipment, it is nearly impossible to provide a support structure that will truly work on many diverse models and designs. Unfortunately, when the lift does not securely engage with the vehicle, the lifting mechanism either cannot engage the vehicle properly, or the vehicle could fall from the lift, damaging both the vehicle and any persons under or near to the vehicle. Ramps, rails and the like tend to suffer from the same access limitation, often completely preventing access to an underbody or similarly positioned servicing and inspection location.

A variety of patents chronicle the extensive development that has taken place over so many years, including for example an early patent to Sandy, U.S. Pat. No. 471,900, which illustrates a winch structure for pulling two ropes used to lift a wagon body or the like. Other patents include U.S. Pat. No. 1,259,942 by Weaver, which illustrates a vehicle hoist that straddles one end of the vehicle or other object to raise it up for maintenance; U.S. Pat. No. 4,861,218 by Lamer, which illustrates a mobile boat hoist; U.S. Pat. No. 6,161,702 by Campbell which illustrates a lifting system for bicycle storage; U.S. Pat. No. 3,734,466 by Mason; U.S. Pat. No. 3,872,972 by Cummins et al; U.S. Pat. No. 4,954,038 by Sheahan; U.S. Pat. No. 5,362,196 by Beattie et al; U.S. Pat. No. 5,797,504 by Mangum; U.S. Pat. No. 5,813,659 by Heidle; U.S. Pat. No. 5,988,597 to Egan; U.S. Pat. No. 6,056,274 to Naas et al; U.S. Pat. No. 6,361,022 by Lob et al; and U.S. Pat. No. 6,386,515 to Sachtleben. Nevertheless, these patents fail to illustrate or teach the desired storage and service access capabilities that have been sought after for so many years, nor a way to implement such capabilities with well-suited and synergistic materials and components.

SUMMARY OF THE INVENTION

In a first manifestation, the invention is a storage, inspection and repair rack for supporting motorized vehicles selected from the group comprising snowmobiles, all-terrain vehicles and lawn tractors. The storage, inspection and repair rack comprises first and second tubular bridges each having first and second flared ends and rising therefrom to an elevated central section. First, second, third and fourth tubular and generally vertical corner posts each have a flared base and first and second generally transverse tubular connectors. The first tubular corner post is coupled to the first tubular bridge first flared end, the second tubular corner post is coupled to the first tubular bridge second flared end, the third tubular corner post is coupled to the second tubular bridge first flared end, and the fourth tubular corner post is coupled to the second tubular bridge second flared end. First, second, third and fourth tubular longitudinally extensive framing posts each have first and second opposed ends forming tubular connectors that are coupled with ones of the first and second generally transverse tubular connectors of the first, second, third and fourth tubular corner posts. A first base member is coupled to the flared base of the first tubular corner post and extends therefrom between first and second tubular corner posts and is coupled to the flared base of the second tubular corner post. A second base member is coupled to the flared base of the third tubular corner post and extends therefrom between third and fourth tubular corner posts and is coupled to the flared base of the fourth tubular corner post. A first winch is supported upon the first tubular corner post and has at least one cable extending therefrom wound partially thereon. The at least one cable passes from winch to at least one pulley supported by the first tubular bridge. A second winch is supported upon the third tubular corner post and has at least one cable extending therefrom wound partially thereon, the at least one cable passing from second winch to at least one pulley supported by the second tubular bridge.

In a second manifestation, the invention is the combination of a snowmobile storage, inspection, repair and display rack with a snowmobile having skis and a drive track suspended therefrom. A first archway is adjacent the snowmobile skis, and a first winch is anchored relative to the first archway. A first flaccid member extends between the first winch and snowmobile that engages and supports the snowmobile adjacent the first archway. A second archway is adjacent the snowmobile drive track, and a second winch is anchored relative to the second archway. A second flaccid member extends between the second winch and snowmobile that engages and supports the snowmobile adjacent the second archway. A longitudinally extensive spacer rigidly supports the first archway relative to second, and prevents relative movement therebetween.

OBJECTS OF THE INVENTION

A first object of the invention is to provide an easy-to-use and safe method for storing vehicles and equipment. A second object of the invention is to incorporate commonly available materials that offer exceptional performance, light weight, and utility. Another object of the present invention is to enable access to elevated vehicles and equipment for inspection, cleaning, and repair. A further object of the invention is to provide a versatile support for a diverse range of equipment and machines.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides a storage rack framework 10 fabricated using stock automotive exhaust components, which yields a synergistic combination of ready reforming, substantial strength, low weight, and excellent corrosion and chemical resistance. Further, standard fixtures are available for forming flares 19 within this tubing to permit the formation of very easy-to-assemble couplings, thereby permitting the structure to be assembled from sufficiently short lengths to enable shipment using standard commercial carriers and rates such as are, for example, available from UPS without oversize fees and surcharges. The rack is most preferably designed to work in combination with snowmobiles, though other devices and apparatus may also be accommodated.

Figure 1:
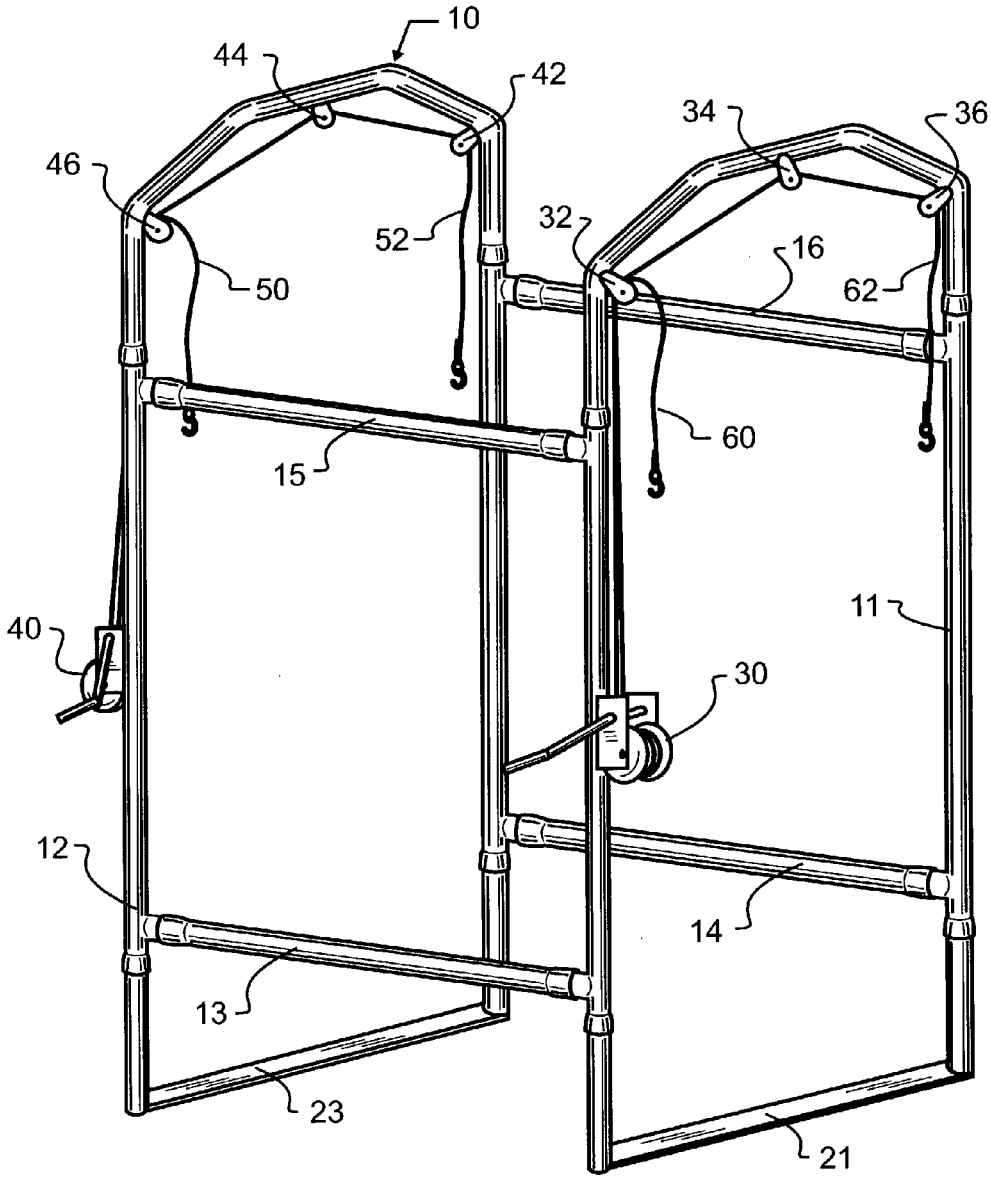
FIG. 1 illustrates a preferred embodiment storage rack designed in accord with the teachings of the invention and without any articles stored thereon from projected elevation view.
Figure 2:
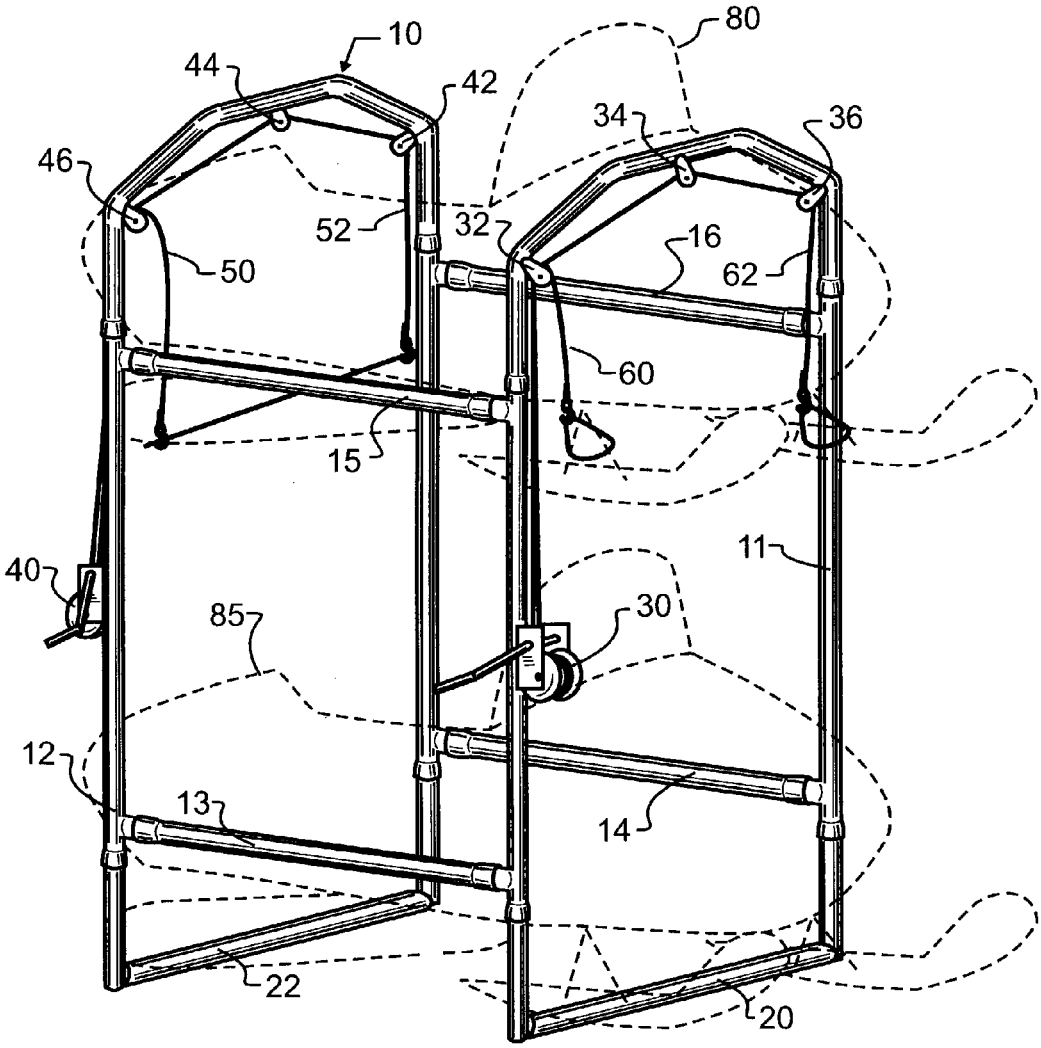
FIG. 2 illustrates the preferred embodiment of FIG. 1 in further combination with an elevated snowmobile.

In a most preferred embodiment of the invention illustrated in FIG. 1, a storage rack 10 is illustrated. FIG. 2 illustrates snowmobiles 80, 85, the details of which are not critical to the invention other than basic features such as track and skis, in the preferred combination supported by storage rack 10. As can be seen therein, rack 10 may be used to support at least one article off of the floor surface, providing sufficient space thereunder for additional storage, service, inspection or other activities.

Rack 10 includes end sections 11 and 12 that have horizontal and longitudinally extending bars 13-16 extending therebetween. At the apex of end section 11 is arch 17 which forms a tubular bridge between corner posts 24 and 25. Adjacent base 23 are two vertically extending base extension members 28 and 29, each which couple with and extend corner posts 24 and 25 respectively. At the apex of end section 12 is arch 18 which forms a tubular bridge between corner posts 26 and 27. Adjacent base 21 are two vertically extending base extension members 31 and 33, each which couple with and extend corner posts 26 and 27, respectively. The placement of lower bars 13, 14 will most preferably be selected to enable a person to place a seat, tool table, support or the like across from one bar to the other, generally transverse to the longitudinal extension of the bars. In one conceived of arrangement, seat 90 may be provided that engages bars 13 and 14, which may be moved longitudinally along the bars. This allows a person to position the seat 90 to any convenient longitudinal position under a snowmobile or other equipment or machine. At the base of end sections 11, 12, and partially or fully encircling the base portion thereof, are plastic tubes 20, 22 as shown in FIG. 2, which may, for exemplary purposes, be manufactured from Poly Vinyl Chloride (PVC), polypropylene, Ultra-High Molecular Weight polyethylene (UHMW) or other similar durable and non-marring plastic. Tubes 20, 22 allow machines such as snowmobiles to be driven within rack 10 without damaging either the bases of end sections 11, 12 or the machine. Additionally, the elevation gained by round base stock helps to keep both snowmobile skis and track away from detrimental ground contact. In one conceived alternative embodiment, the bases 21, 23 of end sections 11, 12 may be formed from flat or nearly flat stock, without the use of plastic tubes 20, 22, as illustrated for exemplary purposes in FIG. 1, which will permit a variety of machines to be driven directly into the central region inside of a perimeter defined by the various framework components of rack 10, including machines with relatively small wheels or low ground clearance.

Rack 10 most preferably includes braking winches 30, 40 which are used to ensure that the article or machine to be elevated is raised in a safe and controlled fashion, preventing run-away release of cables 50, 52, 60, 62. Winch 40 controls the release or uptake of cables 50, 52. Similarly, winch 30 controls the release or uptake of cables 60, 62. Cable 60 extends first vertically up from winch 30 to pulley 32, and, after passing therethrough, extends down vertically and terminates in a hook, clip or other type of fastener that may be conveniently used to support and lift a machine or article. Cable 62 passes vertically from winch to pulley 32 similar to cable 60, but from there extends approximately horizontally across to pulley 34, and then on to pulley 36, which is on an opposite vertical support of end section 11 from pulley 32. After passing through pulley 36, cable 62 extends vertically downward, and also most preferably terminates in a hook, clip or other convenient fastener or attachment means. Additional safety straps may be used as desired to secure the elevated equipment to longitudinally extending bars 13-16.

While other materials and fabrication techniques may be found suitable for a particular application, the most preferred embodiment support is fabricated from automotive exhaust system metal. This metal, typically a steel that may be zinc plated or the like, is produced to be readily formed, which enables the tubing to be bent easily using standard equipment. Owing to the corrosive nature of exhaust gas, these tubes are quite corrosion resistant, and will withstand moisture and salt that may be found on many garage floors, particularly during the winter months. Additionally, exhaust metal has substantial load bearing capacity, and is readily assembled and disassembled. In particular, individual tubes that comprise rack 10 may be formed and packaged for shipment to an end user without requiring oversize containers or the like, thereby keeping shipping costs relatively low. The end-user may readily assemble rack 10, merely by sliding together the various tubing pieces, which, as known in the automotive industry, most preferably include flares 19 to couple together. At the flare connections, it may also be preferred to provide further fasteners and attachment, such as with a bolt 91 passing through both tubes simultaneously. Other modes of attachment and connection include welding, brazing, adhesively fastening and the like, too numerous to specifically mention herein.

A variety of designs have been contemplated for rack 10, including the preferred embodiment already discussed and also as illustrated. In fact, the exact geometry and dimension are not critical to the invention, though the archway is most preferred owing to intrinsic strength of the shape to support and maintain a variety of snowmobiles and other equipment therein.

Another conceived alternative embodiment involves making longitudinally extending tubes 13-16 as mechanically extensible or telescoping tubes, which will allow rack 10 to be lengthened or shortened longitudinally, as desired. End sections 11, 12 may similarly be height adjustable, which similarly will allow rack 10 to be height adjustable. Given the foregoing, it will be understood that adjustment along the width direction is contemplated herein as well.

The preferred rack 10 has particular utility in household and commercial garages, storage areas and the like, where it is desirable to store personal equipment without consuming excess floor space. By covering rack 10 with tarp or custom cover, rack 10 may be used for outdoor storage. In such instance, the benefit of using round base tubes 20, 22 is potentially greater. Additionally, the present rack has much utility where a machine, article or equipment requires service from an underside or when in an elevated position. This is commonplace not just with the snowmobile, but with many other types of sport vehicles, machines, articles, appliances and the like, including for illustrative purposes three and four wheel all terrain vehicles, motorcycles and dirt bikes, personal watercraft, lawn and garden equipment, and many other articles and items too numerous to mentions herein. Additional utility is found in retail showrooms, where space is valuable and the ability to view otherwise hard to see features and components is desired.

While the foregoing details what is felt to be the preferred and additional alternative embodiments of the invention, no material limitations to the scope of the claimed invention are intended. The possible variants that would be possible from a reading of the present disclosure are too many in number for individual listings herein, though they are understood to be included in the present invention. For example, a pair of winches 30, 40 are illustrated in the preferred embodiment. However, none, at least one, or a plurality of winches may be included with the design. Two or more end sections such as end section 11 may be provided, with more than two provided along the longitudinal extension of rack 10. Many other features and alternatives are apparent to those skilled in the art. Consequently, features and design alternatives that would be obvious to one of ordinary skill in the art are considered to be incorporated also. The scope of the invention is set forth and particularly described in the claims herein below.

We claim:

1. A storage, inspection and repair rack for supporting motorized vehicles selected from the group comprising snowmobiles, all-terrain vehicles and lawn tractors, said storage, inspection and repair rack comprising:

first and second tubular bridges each having first and second flared ends and rising therefrom to an elevated central section;

first, second, third and fourth tubular and generally vertical corner posts, each having a flared base and first and second generally transverse tubular connectors, said first tubular corner post coupled to said first tubular bridge first flared end, said second tubular corner post coupled to said first tubular bridge second flared end, said third tubular corner post coupled to said second tubular bridge first flared end, and said fourth tubular corner post coupled to said second tubular bridge second flared end;

first, second, third and fourth tubular longitudinally extensive framing posts, each having first and second opposed ends forming tubular connectors that are coupled with ones of said first and second generally transverse tubular connectors of said first, second, third and fourth tubular corner posts;

a first base member comprising flat stock between said first and second tubular corner posts coupled to said flared base of said first tubular corner post and extending therefrom between said first and second tubular corner posts and coupled to said flared base of said second tubular corner post; a plastic tube radially encompassing said first base member and coextensive therewith generally between said first and second tubular corner posts, a second base member coupled to said flared base of said third tubular corner post and extending therefrom between said third and fourth tubular corner posts and coupled to said flared base of said fourth tubular corner post;

a first winch supported upon said first tubular corner post and having at least one cable extending therefrom wound partially thereon, said at least one cable passing from said winch to at least one pulley supported by said first tubular bridge; and a second winch supported upon said third tubular corner post and having at least one cable extending therefrom wound partially thereon, said at least one cable passing from said second winch to at least one pulley supported by said second tubular bridge, wherein said tubular bridges, said tubular vertical corner posts and said tubular longitudinally extensive framing posts are comprised by automotive exhaust stock tubing.

2. The storage, inspection and repair rack of claim 1 wherein said plastic tube comprises polyvinyl chloride tubing.

3. The storage, inspection and repair rack of claim 1 further comprising fasteners secured to said first tubular bridge first and second flared ends retaining said first and second flared ends in secure engagement with said first and second tubular corner post, respectively.

4. A storage, inspection and repair rack for supporting motorized vehicles selected from the group comprising snowmobiles, all-terrain vehicles and lawn tractors, said storage, inspection and repair rack comprising:

first and second tubular bridges each having first and second flared ends and rising therefrom to an elevated central section;

first, second, third and fourth tubular and generally vertical corner posts, each having a flared base and first and second generally transverse tubular connectors, said first tubular corner post coupled to said first tubular bridge first flared end, said second tubular corner post coupled to said first tubular bridge second flared end, said third tubular corner post coupled to said second tubular bridge first flared end, and said fourth tubular corner post coupled to said second tubular bridge second flared end;

first, second, third and fourth tubular longitudinally extensive framing posts, each having first and second opposed ends forming tubular connectors that are coupled with ones of said first and second generally transverse tubular connectors of said first, second, third and fourth tubular corner posts;

a first base member coupled to said flared base of said first tubular corner post and extending therefrom between said first and second tubular corner posts and coupled to said flared base of said second tubular corner post;

a second base member coupled to said flared base of said third tubular corner post and extending therefrom between said third and fourth tubular corner posts and coupled to said flared base of said fourth tubular corner post;

a first winch supported upon said first tubular corner post and having at least one cable extending therefrom wound partially thereon, said at least one cable passing from said winch to at least one pulley supported by said first tubular bridge; and a second winch supported upon said third tubular corner post and having at least one cable extending therefrom wound partially thereon, said at least one cable passing from said second winch to at least one pulley supported by said second tubular bridge, wherein said tubular bridges, said tubular vertical corner posts and said tubular longitudinally extensive framing posts are comprised by automotive exhaust stock tubing.

5. In combination, a snowmobile storage, inspection, repair and display rack and a snowmobile having skis and a drive track suspended therefrom, comprising:

a first archway adjacent said snowmobile skis;

a first winch anchored relative to said first archway;

a first flaccid member extending between said first winch and said snowmobile that engages and supports said snowmobile adjacent said first archway;

a second archway adjacent said snowmobile drive track;

a second winch anchored relative to said second archway;

a second flaccid member extending between said second winch and said snowmobile that engages and supports said snowmobile adjacent said second archway;

a longitudinally extensive spacer beneath said suspended snowmobile and rigidly supporting said first archway relative to said second archway and preventing relative movement therebetween; and a transversely extensive support longitudinally repositionable upon said longitudinally extensive spacer suitable for supporting a person thereon beneath said suspended snowmobile.

6. The combination of claim 5 further comprising a third flaccid member extending between said first winch and said snowmobile that engages and supports said snowmobile adjacent said first archway.

7. The combination of claim 6 wherein said first flaccid member engages said snowmobile adjacent a first one of said snowmobile skis.

8. The combination of claim 7 wherein said third flaccid member engages said snowmobile adjacent a second one of said snowmobile skis.

9. The combination of claim 8 further comprising a fourth flaccid member extending between said second winch and said snowmobile that engages and supports said snowmobile adjacent said second archway.

10. The combination of claim 9 wherein said second and fourth flaccid members engage said snowmobile adjacent said drive track.

11. The combination of claim 5 wherein said first and second archway are comprised by automotive exhaust stock tubing.

12. The combination of claim 5 wherein said first archway further comprises an arch and a base supporting said arch, said base radially encompassed by a plastic tube, whereby said snowmobile skis may be passed over said base without damaging said snowmobile skis and without damaging said base.

13. The combination of claim 12 wherein said plastic tube comprises polyvinyl chloride tubing.

14. The combination of claim 5 wherein said first archway further comprises an arch and a base supporting said arch, said base formed of a generally flat strip.

15. The combination of claim 5 wherein said longitudinally extensive spacer adjusts longitudinally.

* * * * *